US006447030B1

(12) United States Patent
Meinke

(10) Patent No.: US 6,447,030 B1
(45) Date of Patent: Sep. 10, 2002

(54) DOOR HANDLE ASSEMBLY WITH DETENTED CLOSED POSITION

(75) Inventor: Joseph S. Meinke, Gowen, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 63 days.

(21) Appl. No.: 09/648,846

(22) Filed: Aug. 25, 2000

(51) Int. Cl.[7] ..... E05B 1/00

(52) U.S. Cl. ..... 292/347; 292/DIG. 65; 292/336.3

(58) Field of Search ..... 292/336.2, 347, 292/DIG. 65; 16/412, 413, 444, 445

(56) References Cited

U.S. PATENT DOCUMENTS

| | | | | |
|---|---|---|---|---|
| 6,007,122 A | | 12/1999 | Linder et al. | |
| 6,042,159 A | | 3/2000 | Spitzley et al. | |
| 6,099,052 A | * | 8/2000 | Spitzley | 292/336.3 |
| 6,241,294 B1 | * | 6/2001 | Young et al. | 292/336.3 |

* cited by examiner

*Primary Examiner*—J. J. Swann
*Assistant Examiner*—Matthew E. Rodgers

(74) *Attorney, Agent, or Firm*—Young & Basile, P.C.

(57) ABSTRACT

A motor vehicle door handle assembly for actuating a door latch of the vehicle. The assembly includes a housing adapted to be mounted on the vehicle door, a handle mounted on the door on the housing for pivotal movement between an open position and a closed position, and a latch actuator mounted on the housing, operated by the handle, and operative to unlatch the vehicle door in response to opening movement of the handle. The handle and housing define coacting detent structures operative in response to closing movement of the handle to catch the handle on the housing in the closed position of the handle and thereby resist inadvertent opening movement of the handle in a side impact scenario while allowing forceful opening movement of the handle by an operator. The detent structure on the housing comprises a cantilevered resilient finger and the detent structure on the handle comprises a leading cam surface operative to resiliently move the spring finger outwardly in response to closing movement of the handle, a dwell surface maintaining the finger in its outwardly biased position, and a trailing cam surface moving into a position in confronting relation to a free end of the finger as the handle reaches its fully closed position. The trailing cam surface coacts with the free end of the finger in the closed position of the door to resist inadvertent opening movement of the handle in a side impact scenario while allowing forceful opening movement of the handle by an operator.

14 Claims, 5 Drawing Sheets

30e
30a
30
30d
30j
30k
30e
30g
30h
30i
30f
30c
30b
28c
34
34a
28
28d
28a
28b
38
32a
32c
32b
42
36
32

DOOR HANDLE ASSEMBLY WITH DETENTED CLOSED POSITION

BACKGROUND OF THE INVENTION

This invention relates to handle assemblies and more particularly to handle assemblies for controlling the latch mechanisms on vehicular doors.

Vehicular doors typically include a latch mechanism for latching and unlatching the door to the vehicle body, a handle assembly positioned on the door and operative to control the latch mechanism, and a lock mechanism to selectively render the handle assembly effective or ineffective to operate the latch. It is imperative that side impact against the vehicle, resulting for example from a collision, not result in the inadvertent movement of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in an operating vehicle, side impact can easily result in inertial movement of the door handle to its unlatched position with consequent unlatching of the latch mechanism, consequent opening of the door, and consequent discharge of unbuckled vehicle passengers from the vehicle.

Various attempts have heretofore been made to address the side impact problem and specifically to avoid inadvertent opening of the vehicle door in a side impact situation. In the most commonly employed arrangement, a heavy duty spring is employed in association with the door handle. This spring may be sized, for example, to preclude movement of the door handle to its open position in crash situations involving up to 30 Gs of impact force. Whereas this arrangement satisfies the existing Federal Motor Vehicle Safety Standards with respect to side impact, it also results in a door handle that is very difficult to open because of the heavy duty spring employed in association with the door handle. This arrangement has the further disadvantage that the magnitude of the side impact force that the door handle assembly can withstand without inadvertent opening of the door is limited by the strength of the spring associated with the door handle so that, for example, if the door handle spring is sized to resist a 30 G impact force, any side impact force in excess of 30 G will result in opening of the door.

Other attempts to address the side impact problem have involved door handle assembly designs that, while effective to satisfy the side impact standards, have been unduly complicated and/or expensive and/or maintenance prone.

SUMMARY OF THE INVENTION

This invention is directed to an improved door handle assembly for use with a vehicular door.

More specifically, this invention is directed to a vehicle door handle assembly that operates to preclude inadvertent opening of the door in the event of a side impact against the vehicle.

Yet more specifically, this invention is directed to a vehicle door handle assembly that is simple and inexpensive in design and operation and yet effectively operates to preclude inadvertent opening of the door in a side impact scenario.

The motor vehicle door handle assembly of the invention includes a housing adapted to be mounted on the vehicle door, a handle mounted on the housing for movement between an open position and a closed position, and a latch actuator mounted on the housing, operated by the handle, and operative to unlatch the vehicle door in response to opening movement of the handle.

According to the invention, the handle and housing define coacting detent means operative in response to closing movement of the handle to catch the handle on the housing in the closed position of the handle. This simple detent arrangement resists inadvertent opening movement of the handle in a side impact scenario while allowing forceful opening movement of the handle by an operator.

According to a further feature of the invention, the detent means comprises a resilient finger on the housing coacting with a detent structure on the handle. The use of a resilient finger on the housing further simplifies the construction and operation of the door handle assembly.

According to a further feature of the invention, the handle includes a main body handle portion mounted for pivotal movement on the housing about one end of the handle main body portion; the handle further includes an arm portion extending inwardly from another end of the handle main body portion for coaction with the actuator; and the detent structure is provided on the handle arm portion. Provision of the detent structure on the handle arm portion facilitates coacting engagement with the resilient finger on the housing.

According to a further feature of the invention, the actuator comprises a bell crank pivotally mounted on the housing; one arm of the bell crank is operatively associated with the handle arm portion; and the other arm of the bell crank is operatively associated with the door latch. This arrangement provides a simple and efficient means of converting handle opening movement to unlatching of the door while maintaining a detenting action in the closed position of the handle assembly.

According to a further feature of the invention, the resilient finger is cantilevered on the housing in a position where it is biased resiliently outwardly by the detent structure on the handle in response to closing movement of the handle and springs back to a detent position in which the free end of the finger engages a detent surface on the detent structure as the handle reaches its closed position. This simple cantilevered resilient finger arrangement further simplifies the detent construction and operation.

According to a further feature of the invention, with the handle in its closed detented position, the detent surface is oblique with respect to the primary axis of the finger so that the detent surface may cammingly and resiliently move the finger outwardly to allow forceful opening movement of the handle by an operator.

According to a further feature of the invention, the arm portion of the handle has a hook configuration proximate the free end of the arm portion hookingly engaging one arm of the bell crank lever. This construction further facilitates the smooth and effective operation of the door handle assembly.

According to a further feature of the invention, the hook configuration is provided proximate the free end of the arm portion on one side of the arm portion and the detent structure is provided proximate the free end of the arm portion on another side of the arm portion. This specific arm portion construction further facilitates the smooth and effective operation of the door handle assembly including the detenting action of the handle assembly as the handle assumes its closed position.

According to a further feature of the invention, the housing includes a forward end portion pivotally mounting the forward end of the handle main body portion and a rearward end portion; the rearward end portion of the housing is configured to define a tubular structure defining a passage sized to receive the handle arm portion; and one wall area of the tubular structure is configured to define the resilient finger. This specific housing construction facilitates the detenting interaction between the handle arm portion and the housing.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
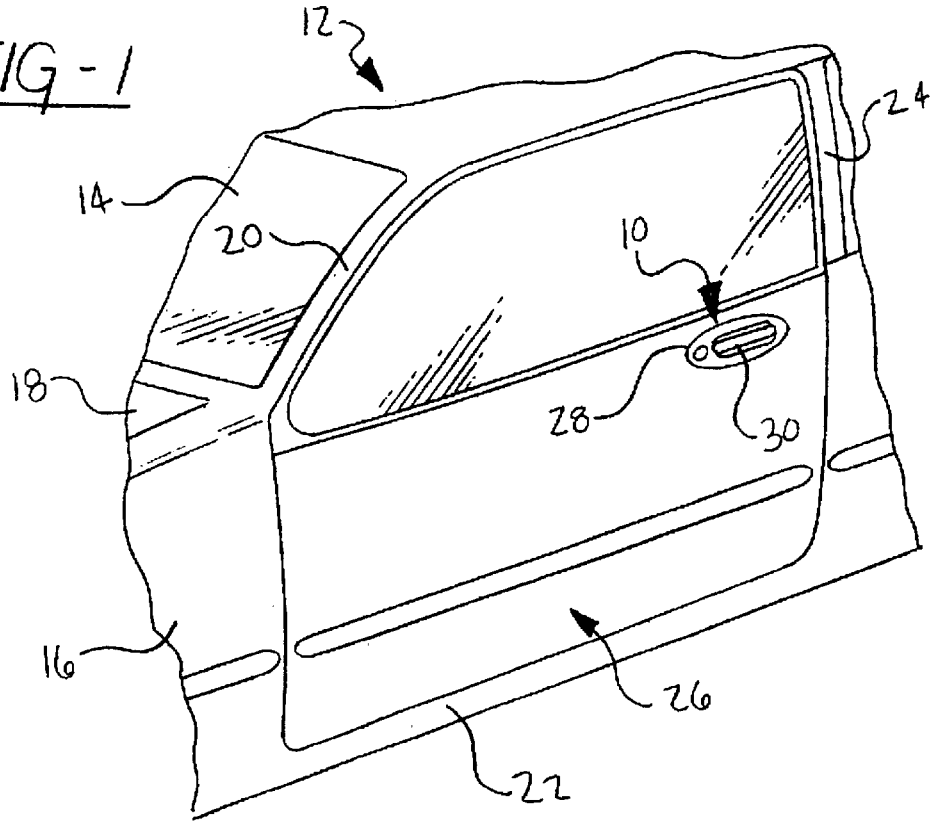
FIG. 1 is a fragmentary perspective view of a motor vehicle including a door embodying the door handle assembly of the invention.
Figure 6:
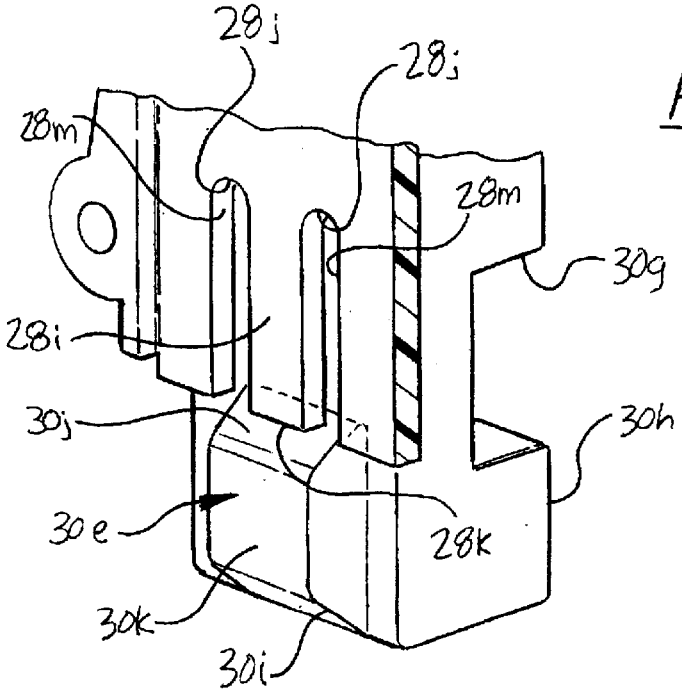
FIGS. 5 and 6 are fragmentary somewhat schematic views illustrating the detenting operation of the invention door handle assembly.

The invention door handle assembly 10 is seen in FIG. 1 in association with a fragmentarily shown motor vehicle 12 including a windshield 14, a front quarter panel 16, a hood 18, an A-pillar 20, a sill 22, a B-pillar 24, and a door 26 positioned in the door opening defined by the A-pillar 20, front quarter panel 16, sill 22, and B-pillar 24.

Figure 2:
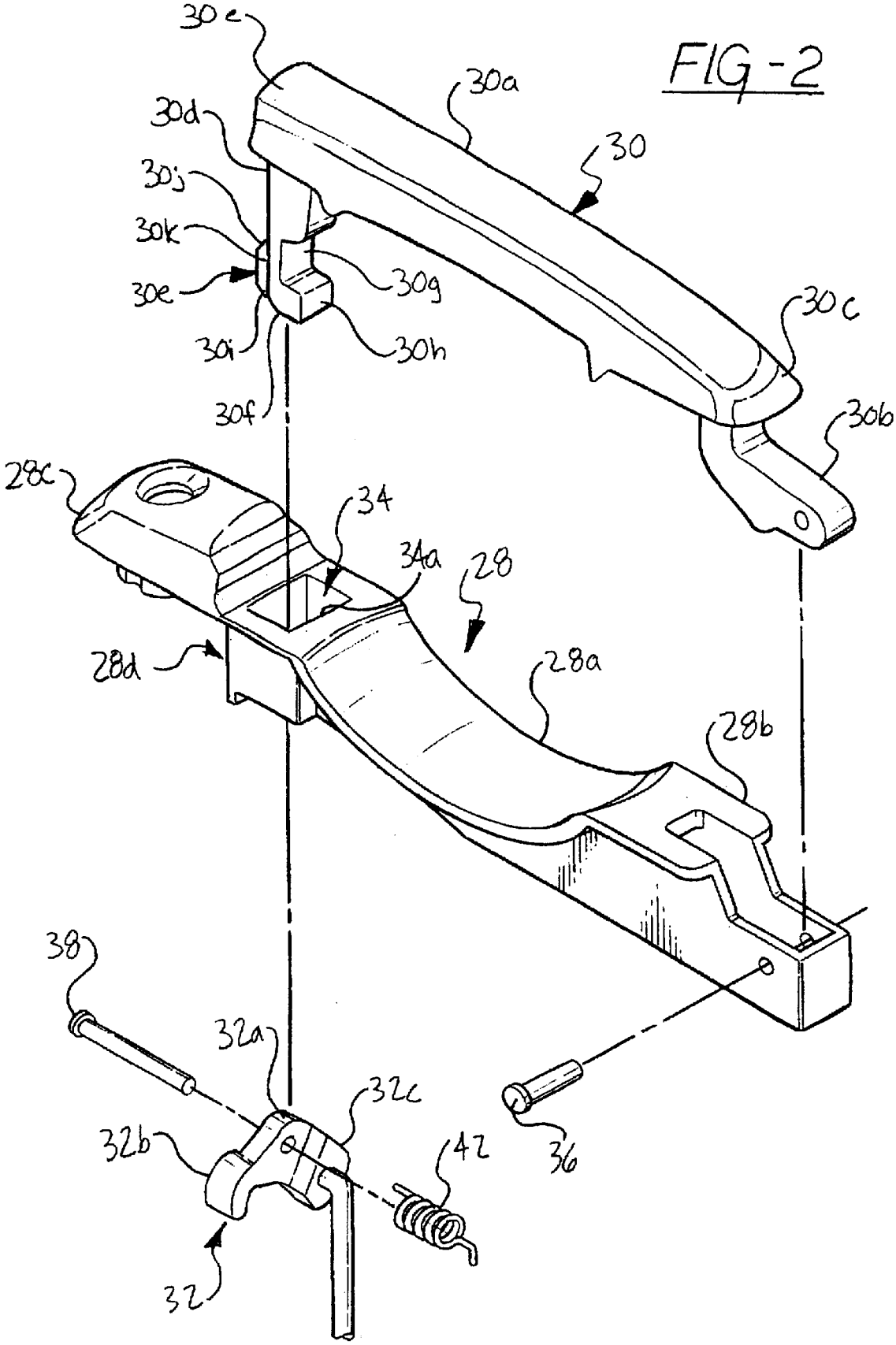
FIG. 2 is an exploded view of the invention door handle assembly.
Figure 3:
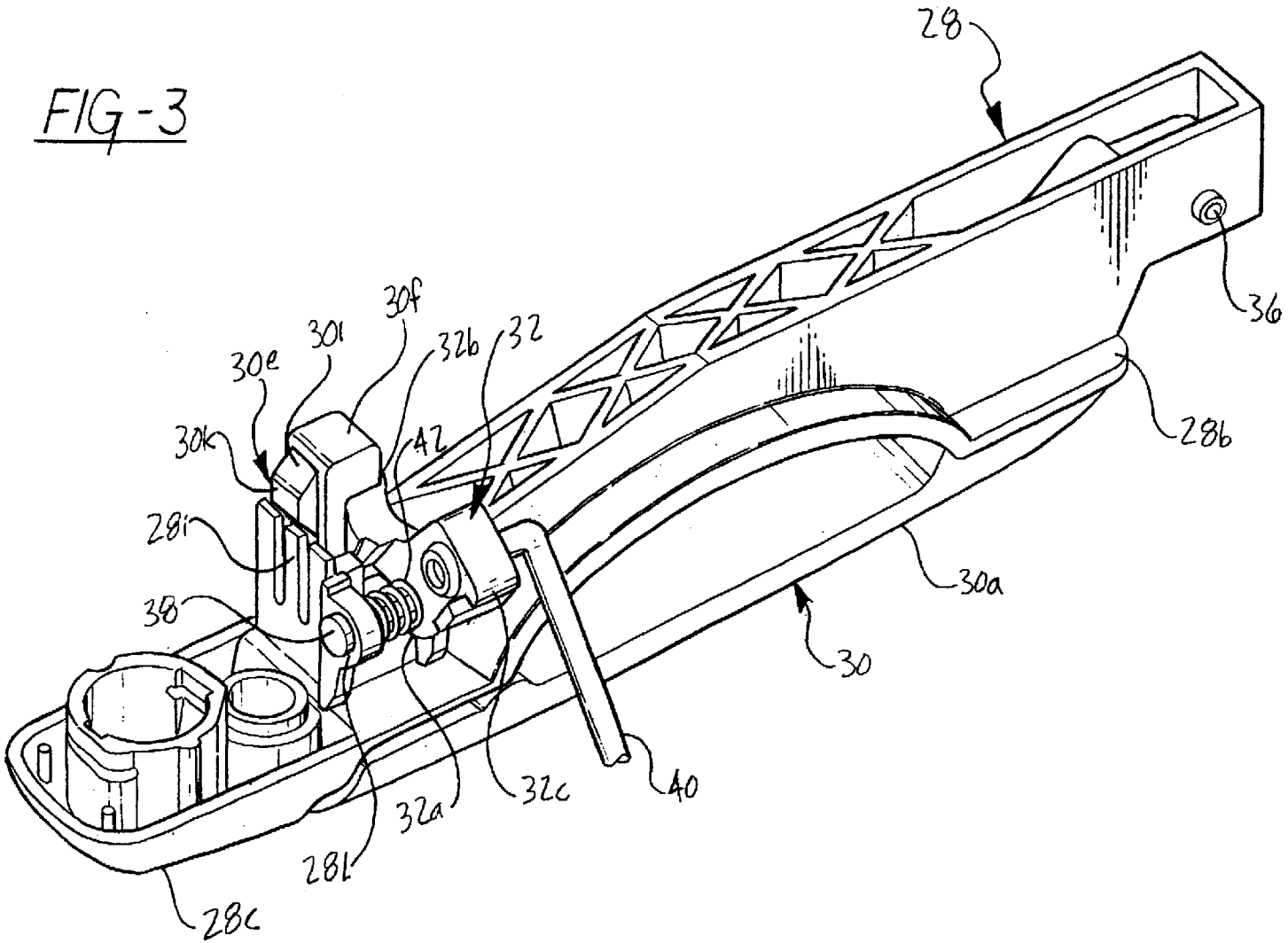
FIG. 3 is a perspective view of the invention door handle assembly.

Door handle assembly 10 (FIGS. 2 and 3) includes a housing or escutcheon 28, a handle 30, and an actuator 32.

Figure 4:
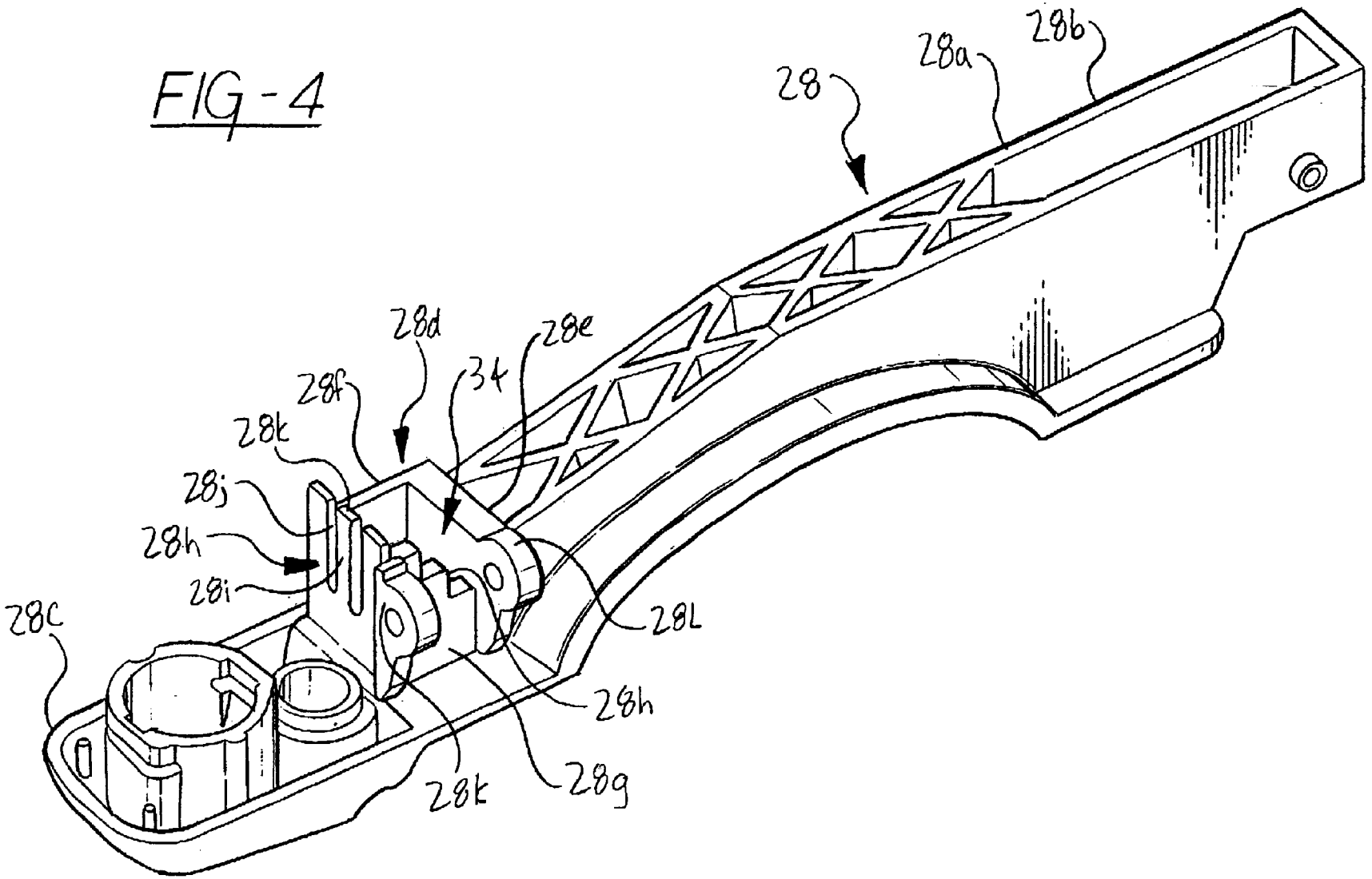
FIG. 4 is a perspective view of a housing employed in the invention door handle assembly.

Housing 28 (FIGS. 2, 3, and 4) may be formed, for example, of a suitable plastic material in a suitable molding operation and includes an elongated main body portion 28*a*, a front pivot end portion 28*b*, a rear lock cylinder end portion 28*c*, and a tubular structure 28*d* proximate rear end portion 28*c*.

Tubular structure 28*d* has a rectangular cross-sectional configuration and includes a solid front wall 28*e*, a solid side wall 28*f*, a stepped side wall 28*g*, and a detent side wall 28*h*.

Detent side wall 28*h* is configured to define a central resilient cantilevered detent finger 28*i* defined by spaced slots 28*j* in detent wall 28*h* and having a free end 28*k*. Spaced parallel ear portions 28*l* are further provided as lateral extensions of walls 28*e* and 28*h*. Walls 28*e, f, g*, and h coact to define a central rectangular passage 34 extending through the tubular structure 28*d* and opening at 34*a* in the outer face of the housing.

Handle 30 (FIGS. 2, 3, 5, and 6) may be formed, for example, of a suitable plastic material in a suitable molding operation and includes an elongated main body portion 30*a*, a pivot structure 30*b* proximate the front end 30*c* of the main body portion, and an arm portion 30*d* extending inwardly of the main body portion 30*a* proximate the front end 30*e* of the main body portion.

Arm portion 30*d* has a cross-sectional configuration sized to be received in passage 34 and includes a detent structure 30*e* proximate the free inner end 30*f* of the arm portion and an actuator drive structure formed by a cut out 30*g* proximate the free inner end 30*f* of the arm portion defining a hook configuration 30*h*.

Detent structure 30*e* will be seen to be provided on one side of arm portion 30*d* proximate the free end 30*f* of the arm portion and cut out 30*g*/hook configuration 30*h* will be seen to be provided on an opposite side of arm 30*d* proximate the free end 30*f* of the arm portion. Detent structure 30*e* is defined by a leading cam surface 30*i*, a trailing cam surface 30*j*, and a dwell surface 30*k* interconnecting cam surfaces 30*i* and 30*j*. Detent structure 30*e* has a width that is less than the distance between the respective outboard edges 28*m* of spaced slots 28*j* so that the detent structure may interact freely with finger 28*i*.

Actuator 32 (FIGS. 2 and 3) is in the form of a bell crank lever and includes a central fulcrum portion 32*a*, an actuator arm portion 32*b*, and a latch arm portion 32*c*.

In the assembled relation of the handle assembly, handle pivot structure 30*b* is pivotally mounted in the front pivot end 28*b* of the housing by a pivot pin 36; handle arm portion 30*d* is received in passage 34 and extends generally parallel to finger 28*i*; bell crank actuator 32 is pivotally mounted between ears 28*k* by a pivot pin 38 with actuator arm 32*b* positioned in cut out 30*g* for coaction with hook configuration 30*h*, latch arm 32*c* pivotally receiving a link 40 connected in known manner to the latch mechanism of the vehicle door, and bell crank fulcrum portion 32*a* received in a notch 28*n* defined by stepped tubular structure wall 28*g*; and a coil spring 42 encircles the shaft of pivot pin 38 and acts in known manner to resiliently resist pivotal door unlatching movement of the bell crank 32 and thereby opening movement of handle 30.

The assembled door handle assembly is positioned (FIG. 5) in an aperture or opening 26*b* in the outer skin 26*a* of the door 26 utilizing suitable fastener means (not shown).

OPERATION

Figure 5:
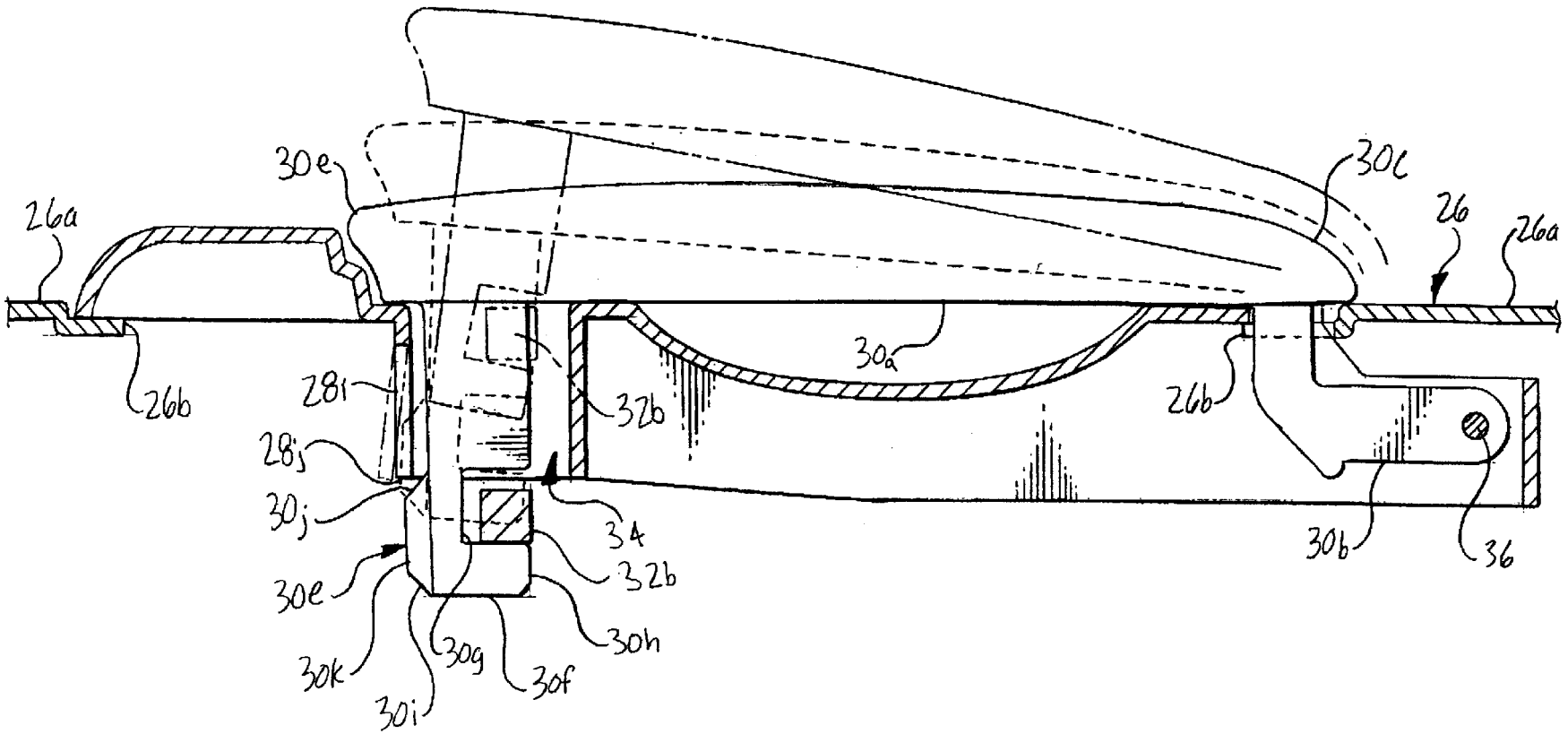

The operation of the door handle assembly is best seen in FIG. 5 wherein the closed position of the handle is seen in solid lines, the open position of the handle is seen in dash lines, and an intermediate closing position of the handle is seen in chain lines. As the handle moves from the open position to the closed position under the urging of spring 42, arm portion 30*d* moves downwardly within passage 34 and leading cam edge 30*i* engages resilient finger 28*i* and, with continued downward movement of the arm portion, biases the resilient finger outwardly to the dash line position seen in FIG. 5 whereafter, with continued downward movement of the arm portion, the dwell portion 38*e* of the cam structure moves along the inner surface of the resilient finger whereafter, with further downward movement of the arm portion, the dwell surface 30*e* moves clear of resilient finger 28*i* and the finger springs back to a detent position in which the free end 28*j* of the finger is positioned in confronting engagement with the trailing cam surface 30*j* of the detent structure. In this position, the resilient finger acts to catch the handle to resist inadvertent opening movement of the handle in a side impact scenario while allowing forceful opening movement of the handle by an operator. Specifically, since surface 30*j* is oblique with respect to the central axis of finger 28*i*, forceful opening movement of the handle is allowed by the camming engagement of trailing cam surface 30*j* with the free end 28*j* of the resilient finger with the cam surface 30*j* camming the resilient finger outwardly to allow the handle to move upwardly to its open position. As the handle moves upwardly to its open position, the dwell surface 30*e* rides along the inner face of the resilient finger whereafter, with continued upward movement of the handle, the spring finger is allowed to return to its solid line position awaiting the subsequent closing movement of the handle.

The invention will be seen to provide a vehicle door handle assembly that is simple and inexpensive in design and which yet effectively precludes inadvertent opening movement of the handle in a side impact scenario.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A motor vehicle door handle assembly for actuating a door latch of the vehicle to allow opening and closing of the vehicle door, the assembly including a housing member adapted to be mounted on the vehicle door, a handle member mounted on the housing member for movement between an open position and a closed position, and a latch actuator mounted on the housing member, operated by the handle member, and operative to unlatch the vehicle door in response to opening movement of the handle member, characterized in that:

one of said members defines a resilient finger coacting with a detent structure on the other of said members in response to closing movement of the handle member to catch the handle member on the housing member in the closed position of the handle member and thereby resist inadvertent opening movement of the handle member in a side impact scenario while allowing forceful opening movement of the handle member by an operator.

2. A motor vehicle door handle assembly for actuating a door latch of the vehicle to allow opening and closing of the vehicle door, the assembly including a housing adapted to be mounted on the vehicle door, a handle mounted on the housing for movement between an open position and a closed position, and a latch actuator mounted on the housing, operated by the handle, and operative to unlatch the vehicle door in response to opening movement of the handle, characterized in that:

the handle and housing define coacting detent means operative in response to closing movement of the handle to catch the handle on the housing in the closed position of the handle and thereby resist inadvertent opening movement of the handle in a side impact scenario while allowing forceful opening movement of the handle by an operator; and the detent means comprises a resilient finger on the housing coacting with a detent structure on the handle.

3. A motor vehicle door handle assembly according to claim 2 wherein:

the handle includes a main body handle portion mounted for pivotal movement on the housing about one end of the handle main body portion;

the handle further includes an arm portion extending inwardly from another end of the handle main body portion for coaction with the actuator; and the detent structure is provided on the handle arm portion.

4. A motor vehicle door handle assembly according to claim 3 wherein:

the actuator comprises a bell crank pivotally mounted on the housing;

one arm of the bell crank is operatively associated with the handle arm portion; and the other arm of the bell crank is operatively associated with the door latch.

5. A motor vehicle door handle assembly according to claim 2 wherein the resilient finger is cantilevered on the housing in a position where it is biased resiliently outwardly by the detent structure on the handle in response to closing movement of the handle and springs back to a detent position in which a free end of the finger engages a detent surface on the detent structure as the handle reaches its closed position.

6. A motor vehicle door handle assembly according to claim 5 wherein, with the handle in its closed, detented position, the detent surface is oblique with respect to the primary axis of the finger so that the detent surface may cammingly and resiliently move the finger outwardly to allow forceful opening movement of the handle.

7. A motor vehicle door handle assembly for actuating a door latch of the vehicle to allow opening and closing movement of the vehicle door, the assembly including:

a housing member adapted to be mounted on the vehicle door;

a handle member mounted on the housing for movement between an open position and a closed position;

a latch actuator mounted on the housing member, operated by the handle member, and operative to unlatch the vehicle door in response to opening movement of the handle member; and coacting detent means on the handle member and housing member operative in response to closing movement of the handle member to catch the handle member on the housing member in the closed position of the handle member and thereby resist inadvertent opening movement of the handle member in a side impact scenario while allowing forceful opening movement of the handle member by an operator, the coacting detent means comprising a resilient finger defined by one of said members coacting with a detent structure defined by the other of said members.

8. A motor vehicle door handle assembly for actuating a door latch of the vehicle to allow opening and closing movement of the vehicle door, the assembly including:

a housing adapted to be mounted on the vehicle door;

a handle mounted on the housing for movement between an open position and a closed position;

a latch actuator mounted on the housing, operated by the handle, and operative to unlatch the vehicle door in response to opening movement of the handle; and coacting detent means on the handle and housing operative in response to closing movement of the handle to catch the handle on the housing in the closed position of the handle and thereby resist inadvertent opening movement of the handle in a side impact scenario while allowing forceful opening movement of the handle by an operator, the detent means comprising a resilient finger cantilevered on the housing and coacting with a detent structure on the handle.

9. A motor vehicle door handle assembly according to claim 8 wherein:

the handle includes a main body handle portion mounted for pivotal movement on the housing about one end of the handle main body portion;

the handle further includes an arm portion extending inwardly from another end of the handle main body portion in generally parallel relation to the resilient finger and including a drive structure coacting with the actuator to move the actuator in an unlatching direction in response to opening movement of the handle;

the detent structure is provided on the handle arm portion; and the resilient finger is arranged to be biased resiliently outwardly by the detent structure in response to closing movement of the handle and springs back to a detent position in which a free end of the finger engages a detent surface on the detent structure as the handle reaches its closed position.

10. A motor vehicle door handle assembly according to claim 9 wherein:

the latch actuator comprises a bell crank pivotally mounted on the housing;

one arm of the bell crank is drivingly engaged by the drive structure of the handle arm portion;

the other arm of the bell crank is operatively associated with the door latch.

11. A motor vehicle door handle assembly according to claim 9 wherein, with the handle in its closed, detented position, the detent surface is oblique with respect to the primary axis of the finger so that the detent surface may cammingly and resiliently move the finger outwardly to allow forceful opening movement of the handle.

12. A motor vehicle door handle assembly according to claim 11 wherein the drive structure comprises a hook configuration proximate a free end of the arm portion hookingly engaging the one arm of the bell crank.

13. A motor vehicle door handle assembly according to claim 12 wherein:

the hook configuration is provided proximate the free end of the arm portion on one side of the arm portion; and the detent structure is provided proximate the free end of the arm portion on another side of the arm portion.

14. A motor vehicle door handle assembly according to claim 9 wherein:

the housing includes a main body portion, a forward end portion pivotally mounting the one end of the handle main body portion, and a rearward end portion;

the rearward end portion of the housing is configured to define a tubular structure defining a passage sized to receive the handle arm portion; and one wall area of the tubular structure is configured to define the resilient finger.

* * * * *